US007000898B2

(12) United States Patent
Lim

(10) Patent No.: US 7,000,898 B2
(45) Date of Patent: Feb. 21, 2006

(54) VERTICAL SHUT-OFF VALVE

(76) Inventor: Howard Tak Su Lim, 12210 Rives Ave., Downey, CA (US) 90242

( * ) Notice: Subject to any disclaimer, the term of this patent is extended or adjusted under 35 U.S.C. 154(b) by 0 days.

(21) Appl. No.: 10/980,007

(22) Filed: Nov. 3, 2004

(65) Prior Publication Data

US 2005/0121641 A1 Jun. 9, 2005

Related U.S. Application Data

(63) Continuation-in-part of application No. 10/731,180, filed on Dec. 9, 2003.

(51) Int. Cl.
*F16K 1/48* (2006.01)

(52) U.S. Cl. ..... 251/322

(58) Field of Classification Search ..... 251/214, 251/321, 322, 323, 357
See application file for complete search history.

(56) References Cited

U.S. PATENT DOCUMENTS

| | | | | |
|---|---|---|---|---|
| 2,001,487 | A * | 5/1935 | Doherty | 251/357 |
| 2,473,591 | A * | 6/1949 | Killner | 251/357 |
| 2,628,062 | A * | 2/1953 | Weber | 251/322 |
| 3,949,779 | A | 4/1976 | Olmsted | |
| 4,040,600 | A | 8/1977 | Coppola et al. | |
| 4,073,471 | A | 2/1978 | Lehtinen | |
| 4,077,876 | A | 3/1978 | Southall | |
| 4,140,238 | A | 2/1979 | Dawson | |
| 4,212,448 | A | 7/1980 | Wulf | |
| 4,382,577 | A | 5/1983 | Bregovic et al. | |
| 4,490,836 | A | 12/1984 | Grotloh | |
| 4,603,708 | A | 8/1986 | Altmann | |
| 4,610,424 | A | 9/1986 | Koppers et al. | |
| 4,655,253 | A | 4/1987 | Ourensma | |
| 4,699,359 | A | 10/1987 | David | |
| 4,736,766 | A | 4/1988 | Bathrick et al. | |
| 4,742,841 | A | 5/1988 | Vonderhaar et al. | |
| 4,817,657 | A | 4/1989 | Kovacs | |
| 4,817,662 | A | 4/1989 | Skibowski | |
| 4,858,641 | A | 8/1989 | Titus | |
| 4,862,744 | A | 9/1989 | Zorb et al. | |
| 4,981,157 | A | 1/1991 | Denkinger | |
| 5,024,254 | A | 6/1991 | Yamagiwa | |
| 5,048,791 | A | 9/1991 | Ellison et al. | |
| 5,060,909 | A | 10/1991 | Stanic | |
| 5,099,876 | A | 3/1992 | Rosenberg | |
| 5,100,100 | A | 3/1992 | Benson et al. | |
| 5,149,055 | A | 9/1992 | Huber et al. | |
| 5,207,241 | A | 5/1993 | Babb | |
| 5,242,581 | A | 9/1993 | Mohr | |
| 5,377,952 | A | 1/1995 | Schabert et al. | |
| 6,270,055 | B1 | 8/2001 | Szeteli et al. | |
| 6,308,933 | B1 | 10/2001 | Rasche | |
| 6,508,270 | B1 | 1/2003 | Koyanagi | |

* cited by examiner

*Primary Examiner*—John Bastianelli

(57) ABSTRACT

A vertical shut-off valve is provided to get instant access of a fluid supply delivered from a pressurized inlet source to the outlet of the valve housing body. A movable stem assembly has of an upper member, a ring seal, and a base plate is engaged with a valve seat as the body of the stem assembly is being passed through the opening of the valve seat. The stem assembly urged in a closed position by the pressures from the compression spring and the inlet fluid, being moved away from the valve seat by the external pushing force on the pushbutton assembly, allows the flow passed through the valve seat between the body of the stem assembly and the inner recesses of the valve seat opening. The valve housing body containing the stem assembly is secured with a bottom cover with a ring seal and a top cover which is adjustably placed to lock the ring seal to achieve the sealing and the appropriate movement of the stem assembly.

12 Claims, 6 Drawing Sheets

712
7135
7155
713
715
B
A

D
W
8035
803
802
717
7175
719
78

70
71
712
7135
713
7155
715
717
803
891
89
78
805
806
80

70
71
712
7135
713
7155
715
717
803
891
89
78
80
5
5
6
6

VERTICAL SHUT-OFF VALVE

RELATED APPLICATIONS

This application is continuation-in-part (CIP) of prior U.S. patent application Ser. No. 10/731,180 applied on Dec. 9, 2003, which is fully incorporated herein.

BACKGROUND OF THE INVENTION

1. Field of Invention

This invention relates to a vertical shut-off valve, engaging in control of the fluid flow from a pressurized inlet source to the outlet.

2. Description of the Prior Art

The vertical shut-off valve described in the earlier application is suited to supply fluid manually or automatically for a liquid delivery system in a manner of on-and-off operation. It has been improved by adding new features for better performance, which include an added sealing element in the top cover area, the supplementary grooves for ring seals, a barrier for limiting emplacement of the valve seat in the valve housing body, a valve seat added another stage on the inner wall of the opening for easy tooling and grooves for the ring seal, and novel features on the stem assembly and the pushbutton. In addition, the new features comprise an added key element on the shoulder and the thread of the stem assembly for the grip with a tool for the prevention of spinning.

SUMMARY OF THE INVENTION

The vertical shut-off valve having a valve housing body works solely as an independent component or as a built-in element in the unit. The valve housing comprises an upper chamber and a lower chamber interconnected by a link channel having a valve seat. The lower chamber contains an inlet connected to the pressurized fluid source and the upper chamber encloses an outlet to discharge the fluid released from the lower chamber through the valve seat. The both chambers embrace a stem assembly which moves in linear motion with a reversal of direction as for a valve function.

The movable stem assembly is engaged with the valve seat at the link channel by the pressures released from the compression spring and the pressurized inlet fluid. The stem assembly composed of an elastic ring seal secured between an upper member and a base plate with a fastener is normally urged to the valve seat to close an opening of the valve seat at the link channel. The ring seal has an exposed area from the surrounding grooves of the upper member and the base plate for engagement with the seat, which should be less than the thickness of the ring seal to be secured in the place. The roundness and the elasticity of the ring seal enhance the effectiveness of the sealing toward the round lip of the valve seat by affording tolerance of the lateral movement.

The extended upper member of the stem assembly being out of the valve housing body has a shoulder adjoining means to secure including thread at the end. The shoulder and the means to secure contain a key element including but not limiting one or more flat sided facet or other shape for the purpose of preventing the pushbutton or other mounted parts being spun on the shoulder. Besides, the purpose of this key element is to supply means for holding the stem assembly with a tool to facilitate assembly of the components. The upper member can utilize a pushbutton to make the manual operation easier, wherein the pushbutton contains an opening matched to the shoulder with the key element on the upper member.

The stem assembly has a base plate located in the lower chamber engaged with a compression spring placed on the seat of the bottom cover, wherein the bottom cover secures the lower chamber with a ring seal. The bottom cover secured to the valve housing body with a ring seal has a groove for the proper sealing. The top cover located on the opposite side includes the multiple ring seals to seal the opening and the secured areas. The top cover is rotatably secured to achieve the optimum pressures against the ring seals for the proper sealing and the linear movement of the stem assembly.

The valve seat located in between the upper chamber and the lower chamber is secured to the valve housing body with an elastic ring seal or a gasket. The valve seat is emplaced until a barrier on the valve housing body prevents the excessive proceeding for the safe installation. It encircles the upper member of the stem assembly being through the opening in the middle, wherein the opening has three stages of the inner recesses to facilitate the valve operation and the valve seat assembly in the valve housing body. The upper member of the stem assembly is further extended to the outside of the valve housing body through an opening of the top cover to receive the external force for allowing the release of the pressurized inlet fluid.

DESCRIPTION OF THE PREFERRED EMBODIMENTS

Figure 1:
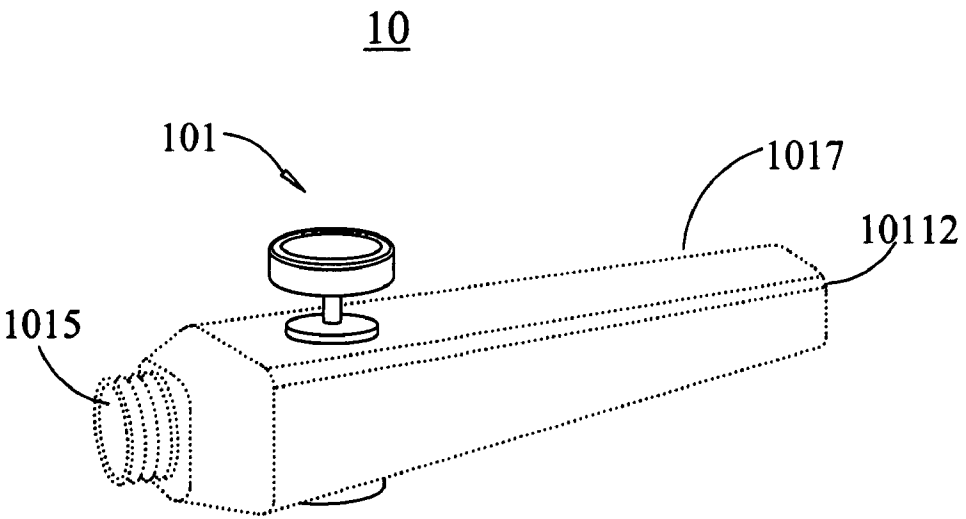
FIG. 1 is a perspective view of the vertical shut-off valve built in a controller as for an intrinsic structure.

In the following detailed description of the vertical shut-off valve, identical elements are provided with the same numbers. The numerals having the same first two digits indicate related elements, such as 30 and 302. The numerals having the same first three digits indicate same components with different elements, such as 302 and 3027. Referring to FIG. 1, a perspective view of the present invention, a vertical shut-off valve, is shown as an illustration of an embodiment built directly into a controller by the number of 10. The vertical shut-off valve system 101 comprises the inlet opening 1015 and the outlet opening 10112 on the controller body 1017.

Figure 2:
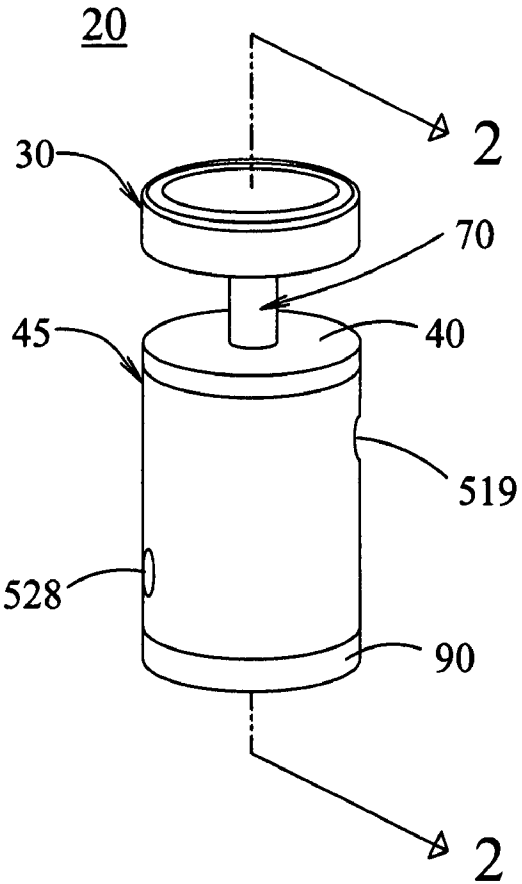
FIG. 2 is a perspective view of the vertical shut-off valve built in a cylinder as for an independent structure.

However, the vertical shut-off valve built in a cylinder as shown in the FIG. 2 takes a clear view as a discrete unit, which will be generally used for the description of the present invention. The isolated shut-off valve unit may be inserted into a controller to use a single entity as well. The structure of this kind is suitable when the vertical shut-off valve housing body is made of different material from the controller body as is in the brass crafted valve housing combined into the plastic molded controller. The vertical shut-off valve 20 comprises a valve housing 45 having an inlet opening 528 and an outlet opening 519, a top cover 40, a bottom cover 90, a stem 70, and a pushbutton 30. The valve housing can take any shape of body including cylinder, hexagonal bar, and rectangular bar. The pushbutton 30 here is attached for assisting the manual movement of the stem 70, which can be replaced with any element having a linear motion with a reversal of direction such as a trigger handle that implements a leverage to gain valve operation force.

Figure 3:
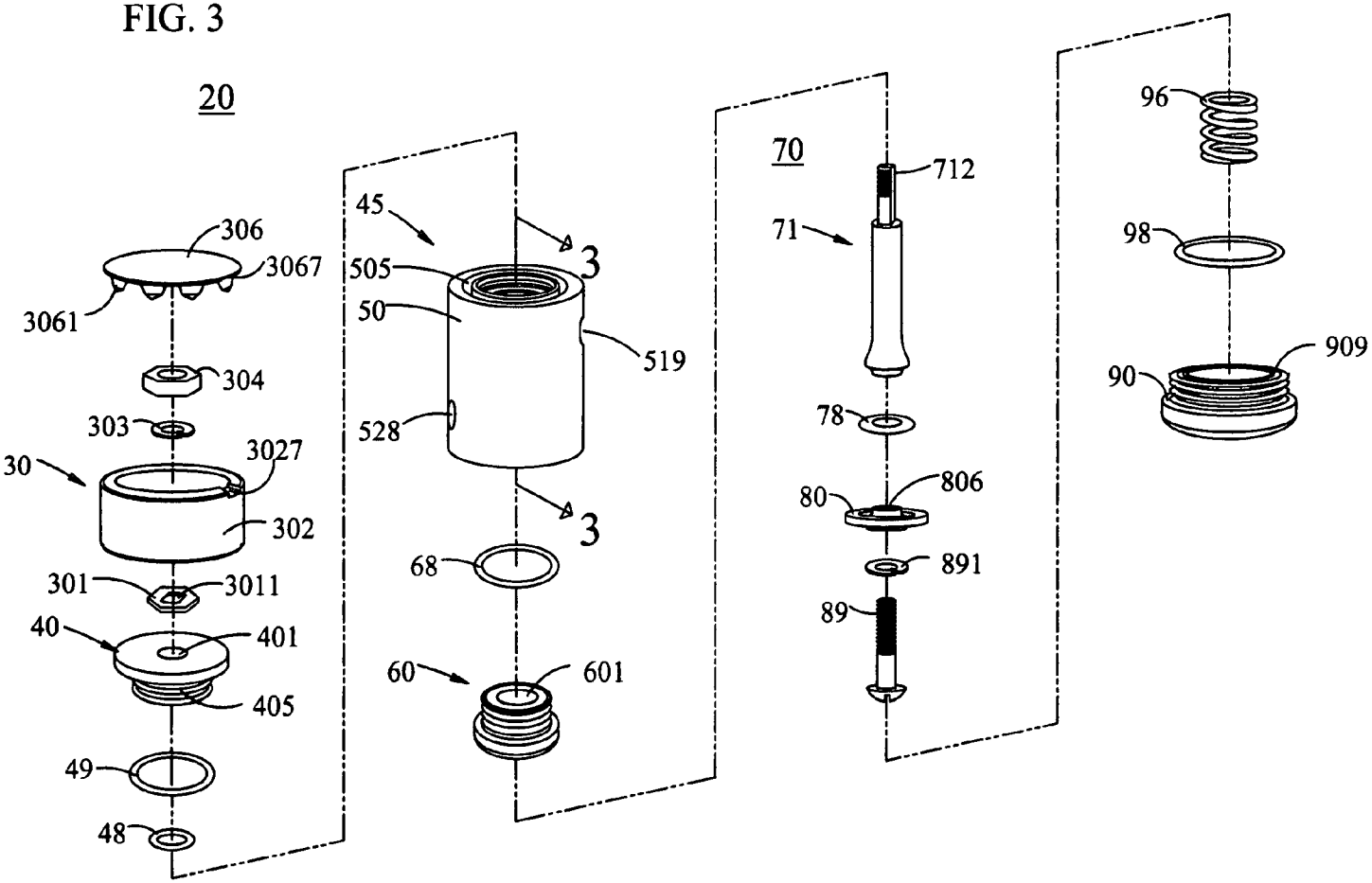
FIG. 3 is an exploded view of the vertical shut-off valve in FIG. 2 made in accordance with the present invention.
Figure 7:
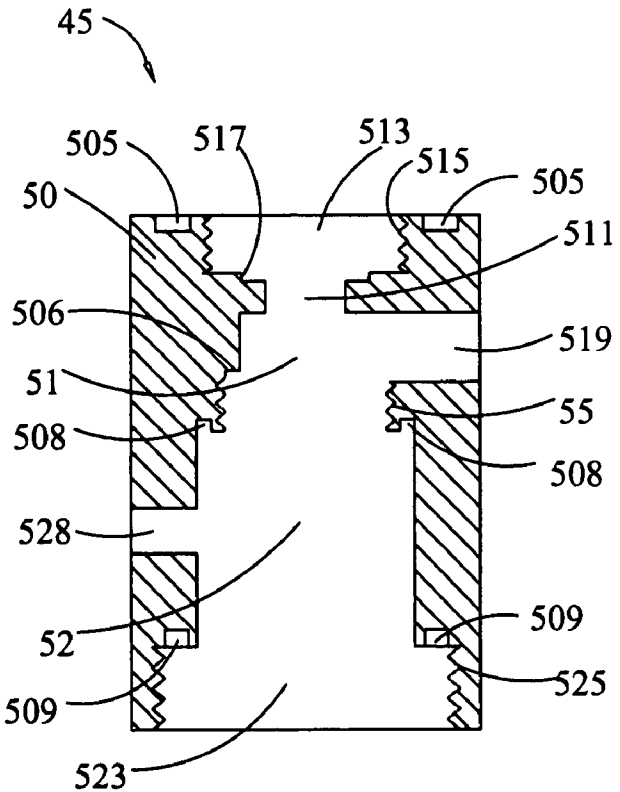
FIG. 7 is a section view of the valve housing body taken from 3—3 in FIG. 3.

The valve housing body 50 of the valve housing 45 as shown in the exploded view in FIG. 3 contains an internal structure as shown in FIG. 7 that the stem assembly moves vertically against the fluid flow direction, nominated a vertical shut-off valve. The valve of this kind is convenient when the fluid flow path runs in a right angle against the direction of the valve operation force. The internal structure of the valve housing body 50 in FIG. 7 comprises two chambers—an upper chamber 51 and a lower chamber 52—divided by the link channel 55. The upper chamber 51 located above the link channel 55 contains an outlet opening 519 for the discharged fluid and a small opening 511 for the upper member 71 in FIG. 3 of the stem assembly 70 passed through.

Figure 8:
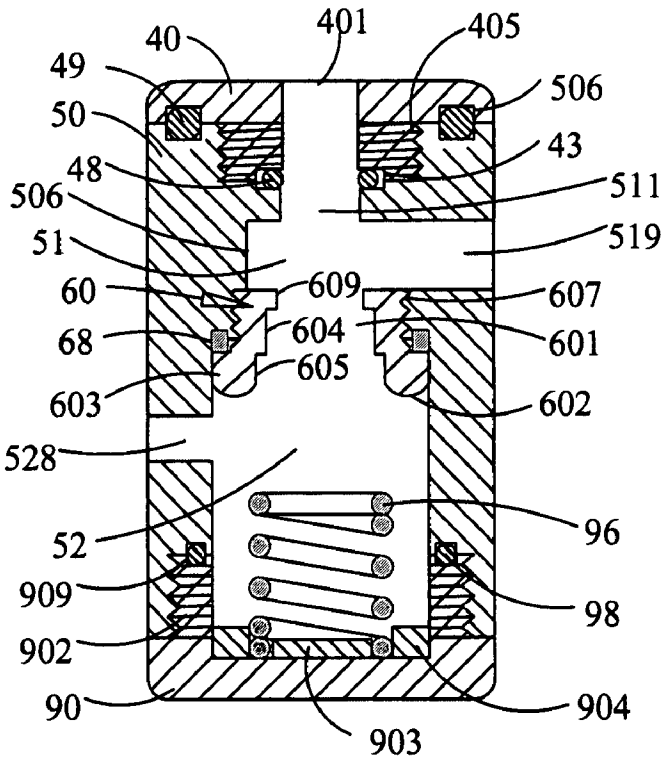
FIG. 8 is a view of FIG. 7 with internal components assembled except the stem assembly.

The opening 511 of the upper chamber 51 in FIG. 7 is further extended to a larger opening 513 having means to secure 515 including thread and a groove 517 for the ring seal 48 in FIG. 8. The large opening 513 in FIG. 7 is secured with a top cover 40 in FIG. 3 which in turn seals the said opening 511, wherein the upper member 71 of the stem assembly 70 in FIG. 3 is passed through to receive the operating pressure from the outside. The large opening 513 in FIG. 7 is further sealed with a ring seal 49 in FIG. 8 seated in the groove 505 under the top cover 40, wherein the top cover 40 in FIG. 3 has means to secure 405 including thread against the means to secure 515 in FIG. 7 on the body to enclose the ring seals 48, 49 in FIG. 3 for sealing. The top cover 40 in FIG. 3 also has an opening 401 for being passed through the upper member 71 of the stem assembly 70 in the central area. It contains a seal groove 405 in FIG. 8 to secure the ring seal 49 for sealing.

The lower chamber 52 in FIG. 7 is located below the link channel 55, which contains an inlet opening 528 leading to a pressurized fluid source. The lower chamber includes the ring seal and the base plate of the stem assembly 70 and the compression spring 96 in FIG. 3 seated in the bottom cover 90. The lower chamber is united to a large opening 523 having means to secure including thread 525 in FIG. 7 with the means to secure including thread 902 in FIG. 8 of the bottom cover 90 in FIG. 8. The bottom cover 90 sealing the large opening 523 is secured with a ring seal 98 seated in the groove 509 on the valve housing body 50. The bottom cover 90 can contain the groove 909 for the ring seal 98 to secure. The bottom cover 90 in FIG. 8 also comprises a base 903 or a support 904 for the spring 96 to be held in the place without displacement.

Figure 4A:
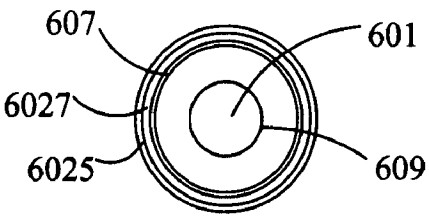
FIG. 4A is a plan view of the valve seat taken from 4A in FIG. 4.
Figure 4B:
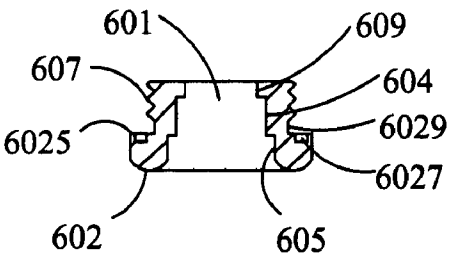
FIG. 4B is a section view of the valve seat taken from 4B—4B in FIG. 4.
Figure 4C:
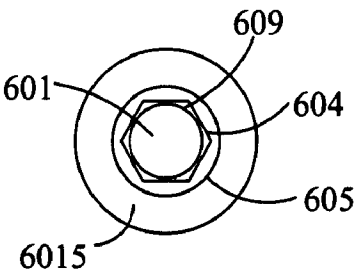
FIG. 4C is a plan view of the valve seat taken from 4C in FIG. 4.
Figure 4:
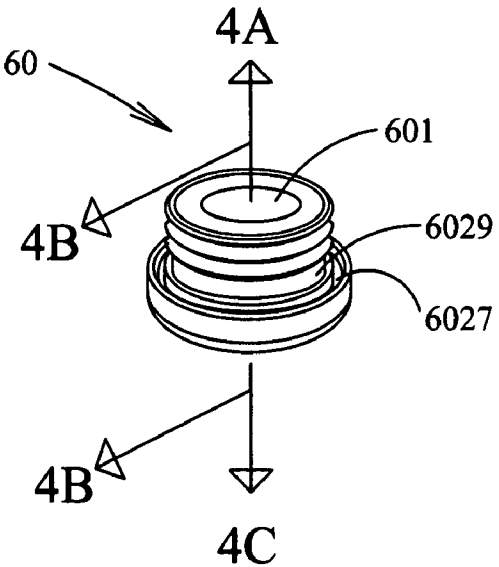
FIG. 4 is a perspective view of the valve seat.

The valve seat 60 in FIG. 4 located in the link channel 55 in FIG. 7 is secured as shown in FIG. 8 to the valve housing body 50 with a ring seal 68 or a gasket in the groove 508 in FIG. 7. The opening 601 of the valve seat in FIG. 4, wherein the upper member 71 of the stem assembly 70 and the released fluid are passed through, has three stages—the one opening 605 In FIG. 4B as the first stage near the bottom, the next opening 604 as the second stage in the middle, and the last opening 609 as the third stage at the top. The first opening 605 is normally round for placing the protuberance element 717 in FIG. 5 of the stem assembly 70, the second opening 604 is in a none-circular shape including a polygon shape such as a hexagon or an octagon for the purpose of tooling, and the third opening 609 is smaller than the second opening in order to prevent the tool being through the opening thoroughly. The valve seat with the second type opening 604 can be easily secured into the link channel 55 of the valve housing body 50 using a tool without free turning. Moreover, the valve seat with the third type opening 609 in FIG. 4B can be more easily secured into the valve housing body, because the inserted tool into the opening 604 stops at the third small opening 609 so that the pushing force obtained from the tool can be utilized to place the valve seat into the valve housing body.

The valve seat 60 in FIG. 4 has the mean to secure including thread 607 in FIG. 4B to secure to the link channel 55 in FIG. 7, wherein the barrier 506 in FIG. 7 of the valve housing body 50 determines the proceeding of the valve seat 60 into the valve housing body 50. Consequently, the valve seat 60 will get protected from the excessive tightening and the ring seal or the gasket 68 in FIG. 3 will not be unnecessarily pressed down by the flange element 6025 in FIG. 4A, FIG. 4B for sealing. The valve seat 60 has a groove 6027 for the ring seal or gasket on the flange element or a groove 6029 on the body under the flange element. The valve seat 60 contains a lip 602 in FIG. 4B which is engaged with the ring seal 78 of the stem assembly 70 in FIG. 5 for sealing. The round dome of the valve seat 60 affords more rooms for sealing than the flat surface, affording some tolerance for engagement of the stem assembly 70. The smooth surface of the dome area of the valve seat 60 supplies good sealing with the ring seal 78 of the stem assembly 70.

Figures 5, 5A, 6, 6A:
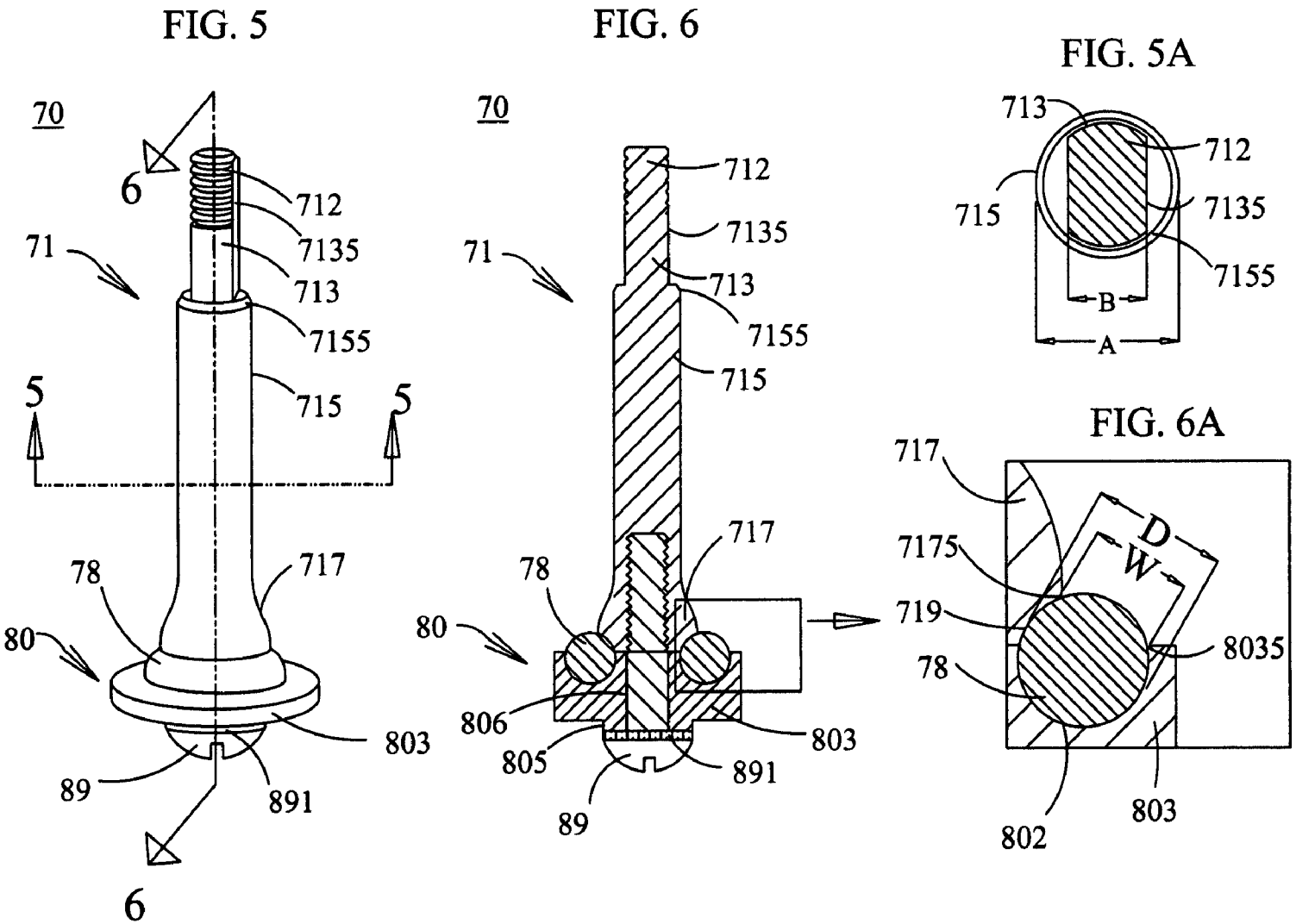
FIG. 5 is a perspective view of the stem assembly.
FIG. 5A is a plan view of the stem assembly taken from 5—5 in FIG. 5.
FIG. 6 is a section view of the stem assembly taken from 6—6 in FIG. 5.
FIG. 6A is a detailed view of fragmentary enlargement of FIG. 6.

The stem assembly 70 in FIG. 4 comprises an upper member 71, a ring seal 78, a base plate 80, a lock washer 891, and a fastener 89. The upper member 71 extended to the outside of the valve housing is passed through the opening of the valve stem. The base plate 80 under the upper member forming a disk absorbs the pressures from the inlet fluid source and compression spring 96 in FIG. 8, releasing them to urge the ring seal 78 against the valve seat 60. The base plate contains a groove 802 for the ring seal 78 on one side and a protruding element 805 in FIG. 6 on the other at the central area for securing the compression spring 96. The base plate is secured to the upper member 71 through an opening 806 in the middle by the fastener 89 and the lock washer 891 with the ring seal 78 placed in between in the grooves 719, 802 in FIG. 6A, creating a stem assembly 70 as one distinctive unit as shown in FIG. 5. The groove 719 on the upper member and the groove 802 on the base plate contain break corners 7175, 8035 in FIG. 6A to avoid damage of the ring seal 78.

Figure 9:
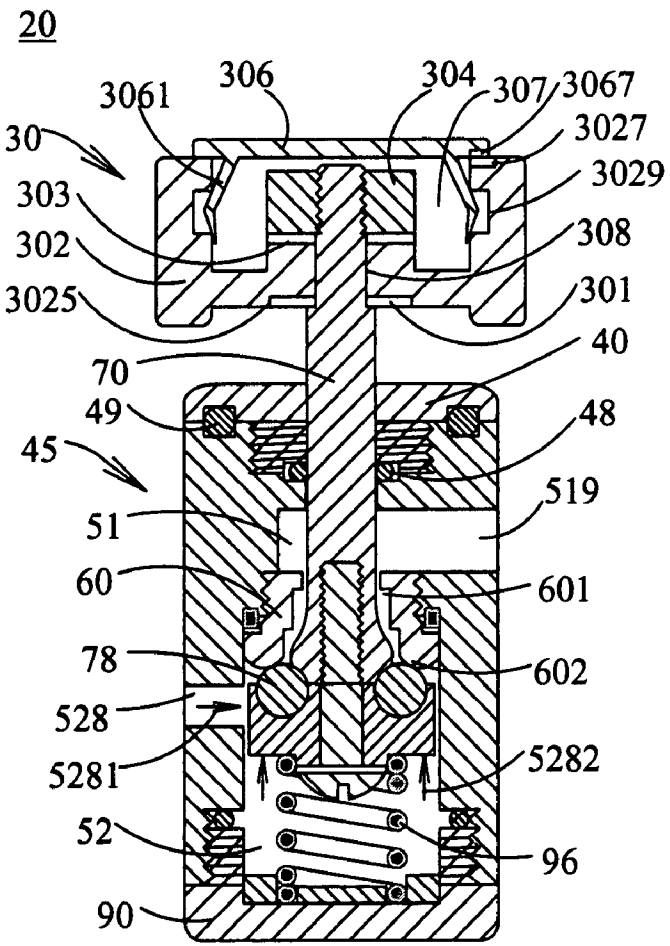
FIG. 9 is a section view of the vertical shut-off valve taken on the line 2—2 in FIG. 2, wherein the stem assembly is engaged with the valve seat showing the valve in closed motion.

The upper member 71 of the stem assembly 70 in FIG. 4 comprises a protuberance element 717 at the lower area, a shaft 715 in the middle, a shoulder 713 at the top, and means to secure including thread 712 for fastening. The protuberance element 717 has a groove 719 in FIG. 6A to keep the ring seal 78 in the place with a break corner 7175 to prevent the ring seal being damaged. The stream lined surface of the protuberance element 717 on the upper member 71 restrains and stabilizes movement of the stem assembly 70 at the first stage opening 605 of the valve seat 60 in FIG. 4B, wherein the coaxially round element of the protuberance element 717 is fitted in any direction. The shaft 715 in FIG. 5 is extended its length to the outside of the valve hosing 45 as shown in FIG. 9 for communication. The smooth and round surface of the shaft contributes good sealing with the ring seal 48 in FIG. 9 and the lead-in chamfer 7155 in FIG. 5 on the edge is set to avoid seal damage.

The shoulder 713 in FIG. 5 of the upper member 71 is set for placing a pushbutton 30 in FIG. 3 or any attachable parts to control the stem assembly 70 for the valve stroke. The shoulder 713 has its smaller width (B) in FIG. 5A lesser than the diameter (A) of the shaft 715, so that any attachable part on the shoulder 713 including the pushbutton 30 is stayed on the shoulder for the proper operation. The shoulder is further extended to the thread 712 in FIG. 5, which holds a locknut 304 with a lock washer 303 in FIG. 9 to secure the pushbutton 30 or other attachable parts. Besides, the shoulder 713 and the thread 712 contain a key element including one or more flat facets 7135 along the column to prevent the attachable parts rotated by themselves. The key element is also used for holding the upper member 71 with a tool to assemble or secure other related parts.

The ring seal 78 in FIG. 5 in the grooves becomes deformed or displaced from the initial place by the pressures urged upon, resulting to failure of the sealing function. The ring seal 78 secured in the round grooves 719, 802 in FIG. 6A matched to its curvature and thickness distributes the absorbed pressures over the entire grooves, establishing the maximum supportive areas with the minimum deformation. In addition to the above features, the ring seal has the minimum exposed width W in FIG. 6A less than the thickness D to avoid its displacement, formulated as the following:

$$W<D$$

to keep the ring seal 78 in the grooves for the proper function of the stem assembly 70 without displacement.

The difference between the exposed width W and the thickness D of the ring seal is nominated a absolute value of the difference (D−W), which is one of the factors to determine the stability of the ring seal 78 placed in the grooves 719, 802 in FIG. 6A. However, the absolute value of the difference becomes less meaningful when it is applied to the various sizes of ring seal, adopting a value of the relative difference ratio. The relative difference ratio is the ratio that the absolute value of the difference is compared to the thickness of the ring seal, and formulated as the following:

$$\text{Relative Difference Ratio}=(D-W)/D$$

which imposes more value regarding the stability of the ring seal in the grooves. The larger number of the relative difference ratio holds the more stability of the ring seals in the grooves.

The other factors that affect the stability of the ring seal include the hardness of the ring seal, the measure of bond strength, the means to secure the ring-seal, and the configurations of the ring seal family. The more stability of the ring seal can be achieved from the higher hardness factor of the ring seal and the stronger bond strength of the adhesive if any used. The means to secure the ring seal include a direct molding onto the base plate or a molding plate, not using the separate ring seal or the base plate. The stability of the ring seal can be attained from the varied configurations of the ring seal family in their compatible grooves, wherein the configurations include O-ring seals, square-ring seals, oval-ring seals, quad-ring seals, H seals, or any types of the ring seals that provide the optimum sealing with the valve seat for a wide range of applications. The configurations of the ring seal family require the compatible grooves or the base plate to be secured, in which the base plate can be attached to the top element or consolidated to become one solid piece.

The pushbutton assembly 30 in FIG. 3 comprises a body 302 having an opening in the middle 308 in FIG. 9 for the stem assembly 70, a washer including polygon shape 301, a groove for the washer 3025, a locknut 304 for the stem assembly, a lock washer 303 for the lock nut, and a finish plug 306, a groove 3029 for the finish plug leg 3061 to lock the finish plug in, a slot 3027 for a screwdriver to open the finish plug. The opening 308 on the body 302 in FIG. 9 for the shoulder 713 in FIG. 5 of the stem assembly 70 takes the same shape as the shoulder having a key element to prevent the pushbutton assembly from the rotation. The body 302 has a large opening 307 in FIG. 9 for keeping in the locknut 304 and the lock washer 303, wherein the opening 307 is secured with the finish plug 306 with its legs 3061 snapped in the groove 309. The body 302 also contains a slot 3027 for assisting the removal of the finish plug 306 using a screwdriver. The polygon washer 301 in FIG. 3 having an opening 3011 with the key element 7135 in FIG. 5 of the shoulder 713 can be added in the compatible groove 3025 to reinforce the pushbutton body 302 when the key element 7135 at the small opening 308 is not strong enough to hold the rotation force. The lock nut 304 together with the lock washer 303 is for jointing the body 302 of pushbutton assembly 30 or other control parts to the upper member 71 of the stem assembly 70.

Figure 10:
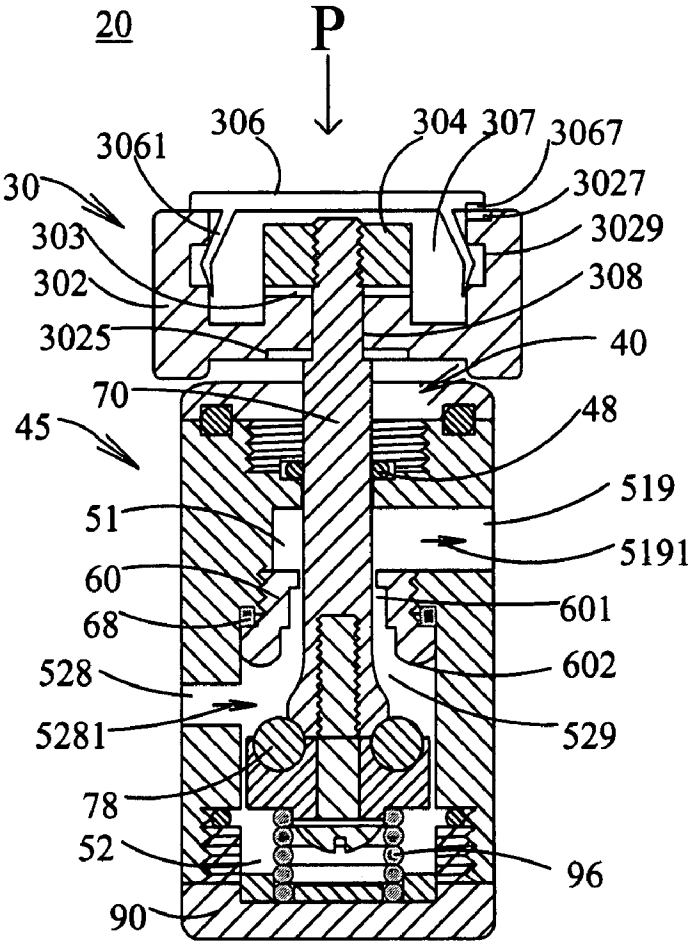
FIG. 10 is a view of FIG. 9, wherein the stem assembly being pressed down by external force P is not engaged with valve seat showing the valve in opened motion.

The vertical shut-off valve 20 in FIG. 9 is in closed state, wherein the ring seal 78 of the stem assembly 70 is in engagement with the lip 602 of the valve seat 60 having no communication between the lower chamber 52 containing the inlet 528 and the upper chamber 51 containing the outlet 519. The stem assembly 70 is being urged against the valve seat 60 by the pressures released from the spring 96 and the pressurized fluid 5282 in FIG. 9, preventing the fluid flow from the inlet 5281 to the upper chamber 51. When the stem assembly 70 is pressed down by the pressure P in FIG. 10, the vertical shut-off valve 20 in FIG. 10 is in open state to allow the fluid flow from the inlet 5281 to the outlet 5191. The pressure ratio of the outlet 519 to the inlet 528 is adjustable by changing the size of the inlet opening compared to that of the outlet opening. The smaller opening at the inlet compared to the one at the outlet lowers the inlet pressures to the level of various applications.

What I claim as my invention is:

1. A vertical shut-off valve which comprises:

a valve housing having a housing body including a lower chamber for the input of the pressurized fluid and an upper chamber for the output of the released fluid, an inlet in said lower chamber, an outlet in said upper chamber, an opening for covering said lower chamber, a bottom cover for covering said opening, means to secure said bottom cover, a ring seal around said opening for sealing said lower chamber, a groove on said housing body for said ring seal around said opening, a groove on said bottom cover for said ring seal around said opening, a compression spring located on said bottom cover, a support on said bottom cover for said compression spring to keep it in place, a base on said bottom cover for said compression spring to keep it in place, a link channel on said housing body located in between said lower chamber and said upper chamber, a valve seat secured on said link channel, a barrier on said housing body for said valve seat to prevent being excessively tightened, means to secure said valve seat to said link channel, a ring seal around said valve seat for sealing, a groove on said housing body for said ring seal around said valve seat, an opening on said housing body locating above said upper chamber, a ring seal on said housing body around said opening for sealing said opening, a groove on said housing body for said ring seal, a top cover for covering said opening, a groove on said top cover for said ring seal around said opening, a channel that links from said opening to the upper chamber for a stem assembly passed through, a ring seal for sealing said channel in said opening, a groove on said housing body to place said ring seal for said channel, a groove on said top cover to place said ring seal for said channel;

a stem assembly located in said lower chamber and said upper chamber through said link channel having the body being passed through the opening of said valve seat and being movable by a reciprocating motion to control the fluid flow from said lower chamber to said upper chamber through said valve seat, wherein a ring seal of said stem assembly is located on the same side as the shaft running direction to engage with said valve seat;

a pushbutton assembly having a pushbutton body including a channel with a key element for placing said stem assembly, a locknut and a lock washer for securing said body to said stem assembly, an opening on said body for placing in said locknut and lock washer, a groove in said opening, a finish plug for covering said opening, a multiple of legs on said finish plug to lock in said groove, a slot on said finish plug for facilitating the removal from said body with a screwdriver, a slot on said body for facilitating the removal of said finish plug from said body, a washer having an opening on said washer same as the channel of said pushbutton body at the center, a groove on said pushbutton body for said washer.

2. A vertical shut-off valve according to claim 1 wherein said stem assembly comprises:

a ring seal being elastic and having an opening in the middle;

an upper member having a body extended to the outside of said valve housing body, a shoulder on said upper member at near one end for placing a reciprocating member, a securing element above said shoulder having means to secure said reciprocating member, a key element on said shoulder and said securing element to prevent said reciprocating member from spinning on the axis of said upper member, a shaft on said upper member next to said shoulder being longitudinal and cylindrical with the surface having sealing quality, a lead-in chamfer or cutout on the edge of said shaft to avoid seal damage, a protuberance element next to said shaft on said upper member at near the other end, stream lined surface on said protuberance element for easy movement of the upper element inside the opening of said valve seat, a groove for said ring seal around said protuberance element, a break corner on said groove to avoid damage of said seal, means to secure a fastener at the end;

a base plate having a flat body for absorbing inlet fluid pressures and then delivering to said ring seal, a groove on one side of said flat body for said ring seal, a break corner on said groove to avoid damage of said seal, a protrude on the other side of said flat body for said compression spring to be anchored, an opening in the central area of said base plate for means to secure;

a fastener including a lock washer as means to secure to combine the components of said stem assembly, configuring said stem assembly a sole working unit in said valve housing.

3. A vertical shut-off valve according to claim 1 wherein said valve seat comprises:

a seat body for being placed in said link channel of said valve housing body;

a means to secure said seat body to said link channel of said valve housing body;

a ring seal for said means to secure;

a groove on said seat body for said ring seal;

a flange element on the outside of said seat body to secure said ring seal;

a groove for said ring seal on said flange element;

an opening having a minimum of three stages in the middle of said body passed through from one end to the other, wherein said three stages include the first opening for said protuberance element on said upper member of said stem assembly, the second opening having a none-circular type not limiting a polygon for the same type driver for tooling, and the third opening smaller than said second opening to bar the said driver passed through;

a lip on said one end of said body around said first opening having a smooth surface for engagement with said ring seal of said stem assembly.

4. A vertical shut-off valve according to claim 1 wherein said top cover comprises:

a top cover body for being placed to cover said opening of said valve housing body;

a flange on the outside of said top cover body for preventing excessive tightening and affording room to secure sealing with said valve housing body;

a means to secure said top cover body to said opening of said valve housing body;

a ring seal for said top cover body to secure said means to secure;

a groove on said flange for said ring seal for said top cover body;

an opening for said upper member of said stem assembly to be passed through for communication with the outside;

a ring seal on said top cover body around said opening to seal said opening;

a groove for said ring seal on said top cover body around said opening.

5. A vertical shut-off valve according to claim 1 wherein said stem assembly having means to secure said ring seal is for avoiding displacement of said ring seal by means of enclosing said ring seal in said grooves in such a way that the exposed width W for engagement with said valve seat is less than the thickness D of said ring seal, formulating $W<D$.

6. A vertical shut-off valve according to claim 1 wherein said stem assembly having means to secure said ring seal is for avoiding displacement of said ring seal by means of enclosing said ring seal in said grooves in such a way that the ratio of the difference of the exposed width W from the thickness D of said ring seal compared to said thickness D is to be greater than zero formulating $((D-W)/D)>0$.

7. A vertical shut-off valve according to claim 1 wherein said stem assembly has means to consolidate said upper member, said ring seal, said fasteners, and said base plate to structure one solid stem with one or more components, wherein a part of said one solid stem passed through said opening of said valve seat for operation.

8. A vertical shut-off valve according to claim 1 wherein said stem assembly has a part of the body to be passed through the said opening of said valve seat.

9. A vertical shut-off valve according to claim 1 wherein said means to secure include various types of thread, adhesive, hook, lock, anchors, welding, or a fastening measures for joining one element to another.

10. A vertical shut-off valve according to claim 1 wherein said ring seal includes, but not limited, an O-ring seal, a quad-ring, or any custom molded ring, made of elastic material.

11. A vertical shut-off valve according to claim 1 wherein said valve housing has a valve seat built in for engagement with said stem assembly, wherein a part of said stem assembly is being passed through the middle opening of said valve seat.

12. A vertical shut-off valve according to claim 1 wherein said grooves for said ring seals contain break corners, radii, and finish.

* * * * *